US006386679B1

(12) United States Patent
Yang et al.

(10) Patent No.: US 6,386,679 B1
(45) Date of Patent: May 14, 2002

(54) CORRECTION METHOD FOR CONTINUOUS INK JET PRINT HEAD

(75) Inventors: Zhihao Yang, Webster; Ravi Sharma, Fairport; Michael E. Meichle; John M. Noonan, both of Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/708,881

(22) Filed: Nov. 8, 2000

(51) Int. Cl.[7] ..... B41J 2/135; B41J 2/02
(52) U.S. Cl. ..... 347/45; 347/47; 347/73
(58) Field of Search ..... 347/78, 73, 74, 347/75, 1, 19, 44, 45, 47, 20, 22, 29, 82; 438/21; 427/559, 384, 421

(56) References Cited

U.S. PATENT DOCUMENTS 4,346,387 A 8/1982 Hertz
5,863,371 A * 1/1999 Takemoto et al. ..... 347/45 X
6,079,821 A 6/2000 Chwalek et al.

FOREIGN PATENT DOCUMENTS

JP 56-167461 A * 12/1981 ..... 347/29

* cited by examiner

*Primary Examiner*—David F. Yockey
(74) *Attorney, Agent, or Firm*—Harold E. Cole

(57) ABSTRACT

A method for correcting the performance of a continuous ink jet print head having a nozzle plate with a plurality of nozzles each having an orifice, at least one of the nozzles being a malfunctioning nozzle, the method including:

a) determining which nozzle of the nozzle plate is malfunctioning;

b) applying a heat-activatable material over the surface of the nozzle plate;

c) applying heat to the malfunctioning nozzle, thereby causing the heat-activatable material to flow into the orifice of the malfunctioning nozzle to block it; and d) removing any excess heat-activatable material.

7 Claims, 1 Drawing Sheet

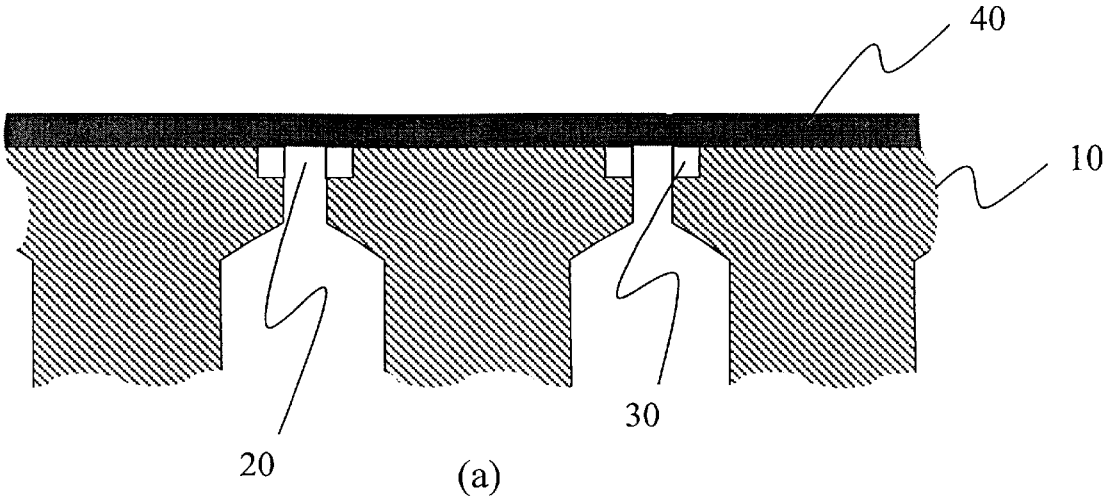
(a)
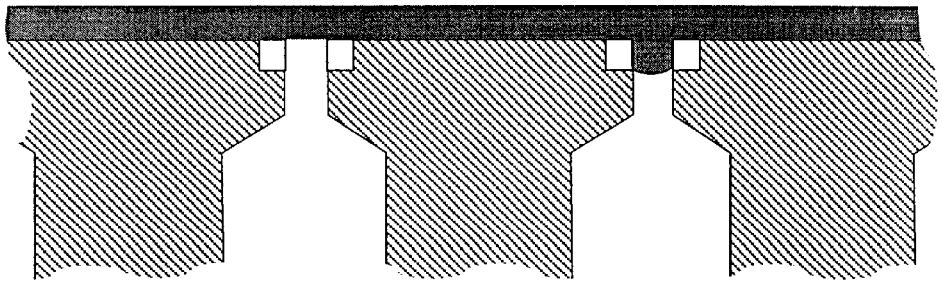
(b)
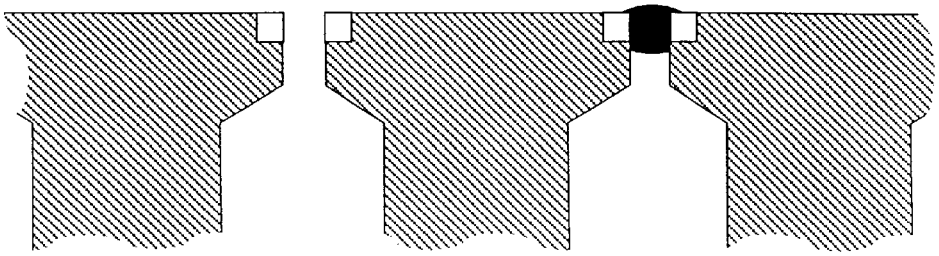
(c)

CORRECTION METHOD FOR CONTINUOUS INK JET PRINT HEAD

FIELD OF THE INVENTION

This invention relates to a correction method for ink jet printing that utilizes a continuous ink jet print head that employs multiple nozzles.

BACKGROUND OF THE INVENTION

Ink jet printers are well known in the printing industry. Ink jet printers are just one of many different types of printing systems that have been developed which include laser electrophotographic printers, LED electrophotographic printers, dot matrix impact printers, thermal paper printers, film recorders, thermal wax printers and dye diffusion thermal transfer printers. Ink jet printing has become recognized as a prominent contender in the digitally controlled, electronic printing industry because of its non-impact, low-noise characteristics, its use of plain paper and its avoidance of toner transfers and fixing. However, there is an ongoing demand for improved digitally-controlled printing systems that are able to produce high color images at a high speed and low cost using standard paper.

U.S. Pat. No. 4,346,387 discloses a continuous ink jet printer which utilizes electrostatic charging tunnels that are placed close to the point where ink droplets are being ejected in the form of a stream. Selected droplets are electrically charged by the charging tunnels. The charged droplets are deflected downstream by the presence of deflector plates that have a predetermined electric potential difference between them. A gutter may be used to intercept the charged droplets, while the uncharged droplets are free to strike the recording medium.

U.S. Pat. No. 6,079,821 disclosed a continuous ink jet printer which utilizes thermal energy to deflect the droplets. A heater section is employed to produce an asymmetric application of heat to an ink stream to control the direction of the stream between a print direction and a non-print direction.

While continuous ink jet printers enjoy the advantage of high printing speed and productivity, there is a problem with them due to malfulnctioning nozzles. For example, a print head is rarely manufactured perfectly, so that there is a small percentage of nozzles in a print head which are imperfect. In addition, a small percentage of nozzles may also become damaged during printing. Without correction, the malfunctioning nozzles on a print head may cause printing failures due to, for example, misdirected jets of ink.

It is an object of this invention to provide a method for correcting the performance of a multi-nozzle, continuous ink jet print head with a malfunctioning nozzle without affecting the performance of the other nozzles.

It is another object of this invention to selectively block a malfunctioning nozzle of an ink jet print head by a thermal triggering technique.

SUMMARY OF THE INVENTION

These and other objects are achieved in accordance with this invention comprising a method for correcting the performance a continuous ink jet print head having a nozzle plate with a plurality of nozzles each comprising an orifice, at least one of the nozzles being a malfunctioning nozzle, the method comprising:

a) determining which nozzle of the nozzle plate is malfunctioning;

b) applying a heat-activatable material over the surface of the nozzle plate;

c) applying heat to the malfunctioning nozzle, thereby causing the heat-activatable material to flow into the orifice of the malfunctioning nozzle to block it; and d) removing any excess heat-activatable material.

By use of the invention, a malfunctioning nozzle can be blocked, without affecting the performance of the other nozzles, so that the print head can continue to be used. The printer can be programmed to use only the functional nozzles.

BRIEF DESCRIPTION OF DRAWING

The drawing in (a) illustrates a cross section of a nozzle plate 10, for an ink jet print head. The nozzle plate has a number of orifices, 20, through which ink is ejected onto a recording element, not shown. Layer 40 on nozzle plate 10 is heat-activatable material which has been-applied to the surface. Heaters 30 sorround each nozzle. In (b), the heat-activatable material has flowed into a malfunctioning nozzle triggered by the heater surrounding the nozzle. In (c), the excess heat-activatable material has been removed, leaving the malfunctioning nozzle plugged.

DETAILED DESCRIPTION OF THE PREFERRED EMBODIMENTS

A nozzle plate for an ink jet print head preferably comprises silicon having an array of orifices through which ink is ejected. The orifices may be prepared by conventional etching techniques. The nozzle plate may also have a metallic oxide or nitride coating. It should be appreciated that other materials besides silicon, such as electro-formed nickel or polyimide, may be used to prepare the underlying nozzle plate as is known in the art. Further, other metals such as gold, silver, palladium and copper may be used to coat the underlying nozzle plate material. As noted above, the ink jet print head employed has multiple nozzles on the nozzle plate.

Identification of a malfunctioning nozzle of a nozzle plate may be determined visually or by inspection with a video camera. In addition, a malfunctioning nozzle may be determined by printing a test pattern and then inspecting it for drop placement accuracy. Other methods for determining if a nozzle is malfunctioning is by electronically sensing the condition of the nozzle, by using time-of-flight measurement or by measuring drop size, which are well known techniques to those skilled in the art.

In a preferred embodiment of the invention, each nozzle of the nozzle plate has at least one addressable heater surrounding the orifice which is used to apply heat to the malfunctioning nozzle. The heaters on the malfunctioning nozzles are selectively fired to melt the heat-activatable material, causing it to flow into the nozzle orifice and plug the nozzle.

The heat-activatable material which may be used in the invention may be a wax, e.g., paraffin, carnauba, ouricuri, spermacati, degras, Carbowax (®, or a polyethylene; a colloidal dispersion, such as aqueous or non-aqueous dispersions of polyolefins, polypropylenes, polyethylenes, microcrystalline wax, paraffin, or plant and animal derived waxes; a hot-melt polymer, such as a polyolefin, poly(ethyl vinyl acetate), polyethylene adipate, a polyester or a polyamide; a thermal-curable or photo-curable material, such as epoxy formulations, isocyanatelbisphenol and isocyanate/bisamine formulations, polyimides or Novalac® resins; or a thermally reversible polymer gel, such as N-alkyl-substituted acrylamide polymers and copolymers or graft copolymers of N-alkyl-substituted acrylamides.

In preferred embodiment of the invention, the heat-activatable material is a thermally reversible polymer gel comprising tri-block copolymers of poly(methyl methacrylate)-b-poly(n-butyl acrylate)-b-poly(methyl methacrylate) (PMMA-PBA-PMMA). It may be employed at a concentration of 3%–40% in a suitable solvent, such as ethanol, propanol, iso-propanol, n-butanol or 2-ethylhexanol. A thermally reversible polymer formulation forms a polymer gel at room temperature with a Young's modulus as low as $2.5\times10^3$ Pa (Mowery, C. L. et. al. "Adhesion of Thermally Reversible Gels to Solid Surfaces", Langmuir, 1997, 13, 6101). At an elevated temperature, e.g., 70° C., the gel melts and the material behaves as a viscous liquid with a typical complex viscosity of about 10 Pa·s at 1 Hz. When the material at the elevated temperature is cooled, gelation occurs very rapidly, forming a gel again.

In another preferred embodiment of the invention, a thermal- or photo-initiated crossliriking agent is added to the thermally reversible gel to make it thermally- or photo-curable. After curing, the gel forms a more robust and permanent plug in the nozzle.

Examples of thermal- or photo-initiated crosslinking agents which may be used include ethylenically unsaturated organic compounds which are radiation or thermal curable materials. These compounds contain at least one terminal ethylene group per molecule and are typically liquids. In a preferred embodiment of the invention, polyethylenically unsaturated compounds having two or more terminal ethylene groups per molecule are employed, such as ethylenically unsaturated acid esters of polyhydric alcohols, e.g., trimethylolpropane triacrylate, pentaerythritol triacrylate or dipentaerythritol hydroxypentaacrylate.

Thermal initiators which are used in the thermal-curable, heat activatable material employed in the invention are disclosed, for example, in "Polymer Handbook", edited by J. Brandrup, E. H. Immergut, $3^{rd}$ edition, Wiley-Interscience, section II/1–II/59, the disclosure of which is hereby incorporated by reference.

Photo-initiators which are used in the photo-curable, heat activatable material employed in the invention are disclosed, for example, in Polymer Engineering and Science, 1983,23, 1022, and U.S. Pat. Nos. 4,366,228; 4,743,528; 4,743,529; 4,743,530; 4,743,531; 4,772,541; and 5,151,520, the disclosures of which are hereby incorporated by reference.

Light sources useful for photo-curable, heat activatable materials useful in the invention include conventional lamps, light-emitting devices, lasers, or light which may be delivered directly, and or through fiber optics.

The heat activatable material can be applied over the surface of the nozzle plate by various methods including spreading with an applicator, spraying, lamination, etc.

In use, a heat-activatable material such as PMMA-PBA-PMMA thermally reversible polymer gel is applied to the surface of a nozzle plate. A heater on a selected malfunctioning nozzle is fired by applying voltage, causing the thermally reversible polymer gel to melt as the temperature increases, e.g., above about 65° C., and flow into the malfunctioning nozzle. The heaters should be energized for period of time, such as from 1 to about 60 seconds to allow the thermally reversible polymer gel to melt and flow into nozzles to form the plugs. The unused thermally reversible polymer gel on the nozzle plate is then removed leaving the malfunctioning nozzle plugged. Various techniques may be used for removing the unused polymer gel such as scraping, delamination, wiping with solvents, etc. The plug may be further hardened and cured to form a permanent plugged nozzle. The plugged material is impervious to inks and maintenance solvents which might be employed.

The following examples illustrate the utility of the present invention.

EXAMPLES

Example 1

Preparation of Thermally Reversible Gel 2 g of tri-block copolymer of PMMA-PBA-PMMA with a weight averaged molecular weight, Mw, of 158,000 and the Mw for the midblock of 103,000 is dissolved in 10 g iso-propanol at 70° C. When the solution is cooled down to room temperature, it forms an opaque gel. The gel melts to liquid when heated to above 65° C. and becomes a gel when cooled down.

Example 2

Preparation of Thermally Reversible and Curable Gel

The PMMA-PBA-PMMA of Example 1 is dissolved in a thermal crosslinking agent, 1 g trimethylolpropane triacrylate, Sartomer® SR351, (Sartomer Co.) and 9 g iso-propanol at 70° C. The solution forms a gel when cooled down to room temperature, and the gel melts at about 65° C. When the temperature is raised to 70° C., the polymer solution was degassed and 10 mg of benzoyl peroxide are added to the solution. The mixture is kept at about 60° C. for 2 hours, and forms a white rubber-like solid. The solid does not melt at temperatures above 70° C., and is not dissolvable in iso-propanol at 70° C.

Example 3

Blocking Malfunctioning Nozzles

A print head with an array of 8 nozzles of approximately 10 $\mu$m in diameter was fabricated with a heater surrounding one-half of the nozzle perimeter. The heaters have an average resistance of about 400Ω. A layer (1–2 mm in thickness) of the gel as formulated in Example 2 is cast on the nozzle plate and covers all nozzles. A voltage of 2.5V is applied to the heater of a malfunctioning nozzle for 30 seconds. The remaining gel is then removed by peeling from the nozzle plate. The block was then further cured at 60° C. for 2 hours.

When the print head was tested, the blocked nozzle stopped jetting ink while the other nozzles remained functioning normally. This shows that the invention was successful in blocking the malfunctioning nozzle.

Although the invention has been described in detail with reference to certain preferred embodiments for the purpose of illustration, it is to be understood that variations and modifications can be made by those skilled in the art without departing from the spirit and scope of the invention.

What is claimed is:

1. A method for correcting the performance of a continuous ink jet print head having a nozzle plate with a plurality of nozzles each comprising an orifice, at least one of said nozzles being a malfunctioning nozzle, said method comprising:

a) determining which nozzle of said nozzle plate is malfunctioning;

b) applying a heat-activatable material over the surface of said nozzle plate;

c) applying heat to said malfunctioning nozzle, thereby causing said heat-activatable material to flow into said orifice of said malfunctioning nozzle to block it; and d) removing any excess heat-activatable material.

2. The method of claim 1 wherein said heat is applied to said malfunctioning nozzle by a heater surrounding said orifice of said malfunctioning nozzle.

3. The method of claim 1 wherein said heat-activatable material is a wax, a colloidal dispersion, a hot-melt polymer, a thermal-curable or photo-curable material or a thermally reversible polymer gel.

4. The method of claim 1 wherein said heat-activatable material comprises a thermally reversible polymer gel of a tri-block copolymer of poly(methyl methacrylate)-b-poly(n-butyl acrylate)-b-poly(methyl methacrylate).

5. The method of claim 4 wherein said heat-activatable material contains an organic solvent.

6. The method of claim 4 wherein said heat-activatable material also comprises a thermal-curable or photo-curable material.

7. The method of claim 6 wherein said heat-activatable material also contains a cross-linking agent.

* * * * *